US005813750A

United States Patent [19]

Chou

[11] Patent Number: 5,813,750

[45] Date of Patent: Sep. 29, 1998

[54] INDICATING LAMP

[76] Inventor: Tien-Ming Chou, No. 41, Shan-Hsi-Wu St., Pei Dist., Taichung City, Taiwan

[21] Appl. No.: 865,188

[22] Filed: May 29, 1997

[51] Int. Cl.[6] ..... H01R 33/06

[52] U.S. Cl. ..... 362/226; 362/800; 362/457

[58] Field of Search ..... 362/226, 249, 362/252, 800, 457; 340/815.45; 439/619, 618; 200/310

[56] References Cited

U.S. PATENT DOCUMENTS 2,703,398 3/1955 Harrington et al. ..... 362/249
4,507,718 3/1985 Bury ..... 362/800

*Primary Examiner*—Y My Quach

*Attorney, Agent, or Firm*—Cushman Darby & Cushman IP Group of Pillsbury Madison & Sutro LLP

[57] ABSTRACT

An indicating lamp includes a base, a lamp member with two fixed electrode pins which are respectively inserted into two pin holes in the base, and a sleeve which is sleeved on an upper end portion of the base. The lamp member is formed with an outwardly extending flange which has an upper end abutting against a shoulder of the sleeve, and a lower end abutting against an upper end of the base while leaving a lower end portion of the base outside the sleeve. The upper end portion of the base is press fitted within a uniform-inner-diameter lower end portion of the sleeve in such a manner that the upper end portion of base has at least one portion which is located within the sleeve and which has an outer diameter slightly larger than the inner diameter of the lower end portion of the sleeve.

2 Claims, 8 Drawing Sheets

INDICATING LAMP

BACKGROUND OF THE INVENTION

1. Field of the Invention

This invention relates to an indicating lamp, more particularly to an indicating lamp which can be easily manufactured.

2. Description of the Related Art

Referring to FIGS. 1, 2A and 2B, a conventional indicating lamp 10 is shown to include a sleeve 11, a lamp member 12, a coiled spring 13, a base 14 having a small-diameter upper end portion 141 and a large-diameter lower portion 142 which defines a shoulder 140 therebetween, a washer 15 and a nut 16.

The sleeve 11 has an outwardly extending flange 111 at the upper end portion thereof, an externally threaded middle portion 112, a central hole 113 formed through the sleeve 11, a small-inner-diameter upper portion 114, a large-inner-diameter lower end portion 114', and a shoulder 115 defined between the portions 114 and 114'.

The lamp member 12 includes a generally cylindrical lamp body 120, an electrode pin unit consisting of a positive electrode pin 121 and a negative electrode pin 122 which have upper ends connected fixedly to the lower end of the lamp body 120 and which are respectively inserted into pin holes 143, 144 in the base 14, and an outwardly extending flange 123 formed on the lower end of the lamp body 120.

The upper end portion 141 of the base 14 is press fitted within the large-inner-diameter lower end portion 141' of the sleeve 11 in such a manner that the lower end of the sleeve 11 abuts against the shoulder 140 of the base 14. As illustrated, two symbols "+", "−" (indicated by the phantom lines in FIG. 1) are marked on the bottom surface of the base 14 for identifying the pin holes 143, 144. The spring 13 is sleeved on the positive electrode pin 121 between the lamp body 120 and the base 14 so as to push the flange 123 upward to abut against the shoulder 115 of the sleeve 11, thereby permitting the lamp body 120 to be seen clearly from the upper end of the central hole 113 of the sleeve 10. The nut 16 engages the externally threaded middle portion 112 of the sleeve 11. The washer 15 is sleeved on the externally threaded middle portion 112 of the sleeve 11 between the flange 111 of the sleeve 11 and the nut 16. After assembly, as illustrated in FIGS. 3A and 3B, the lower end portion 141 is pressed to form a projection 116 (see FIG. 3A) on the inner surface thereof so as to prevent removal of the base 14 from the sleeve 11. The indicating lamp 10 suffers from the following disadvantages:

(1) Provision of the spring 13 increases time and cost of manufacturing the indicating lamp 10.

(2) The pins 121, 122 are inserted into the pin holes 143, 144 according to the symbols "+" and "−", thereby resulting in increased time of assembly.

(3) It is time-consuming to form the projection 116 on the inner surface of the sleeve 11.

(4) Formation of the projection 116 damages an electroplated outer surface of the sleeve 11.

As a result, it is difficult to manufacture the indicating lamp 10.

SUMMARY OF THE INVENTION

An object of this invention is to provide an indicating lamps which can be easily manufactured.

According to this invention, an indicating lamp includes a base having a pin hole unit consisting of two aligned pin holes, a lamp member and a sleeve. The lamp member includes a generally cylindrical lamp body having a lower end formed with an outwardly extending flange, and an electrode pin unit including a positive electrode pin and a negative electrode pin which have upper ends connected fixedly to the lower end of the lamp body and which are respectively inserted into the pin holes of the base. The sleeve has a central hole formed therethrough, a large-inner-diameter lower end portion and a small-inner-diameter upper portion between the inner surfaces of which a shoulder is defined. The large-inner-diameter lower end portion has an inner diameter larger than that of the small-inner-diameter upper portion. The flange of the lamp member has an outer diameter which is smaller than the inner diameter of the large-inner-diameter lower end portion of the sleeve. The small-inner-diameter lower end portion of the sleeve has an inner diameter smaller than the outer diameter of the flange. The base has an upper insert end portion which is press fitted within the lower end portion of the sleeve, in such a manner that the lamp body is received within the small-inner-diameter upper portion of the sleeve and is visible from an upper end of the central hole of the sleeve, and that the flange of the lamp member is located within the large-inner-diameter lower end portion of the sleeve. The base is made of a flexible electrically insulating material. The large-inner-diameter lower end portion of the sleeve has a length which is equal to total length of the flange of the lamp member and the upper insert end portion of the base. Total length of the flange of the lamp member and the base is larger than the length of the large-inner-diameter lower end portion of the sleeve. The upper insert end portion of the base has at least a portion which has an outer diameter slightly larger than the inner diameter of the large-inner-diameter lower end portion of the sleeve. The lamp member has an upper end abutting against the shoulder of the sleeve, and a lower end abutting against an upper end of the base. Preferably, the upper end portion of the base is tapered and reduced upwardly and gradually in outer diameter in order to easily insert the upper end portion of the base into the sleeve during assembly.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
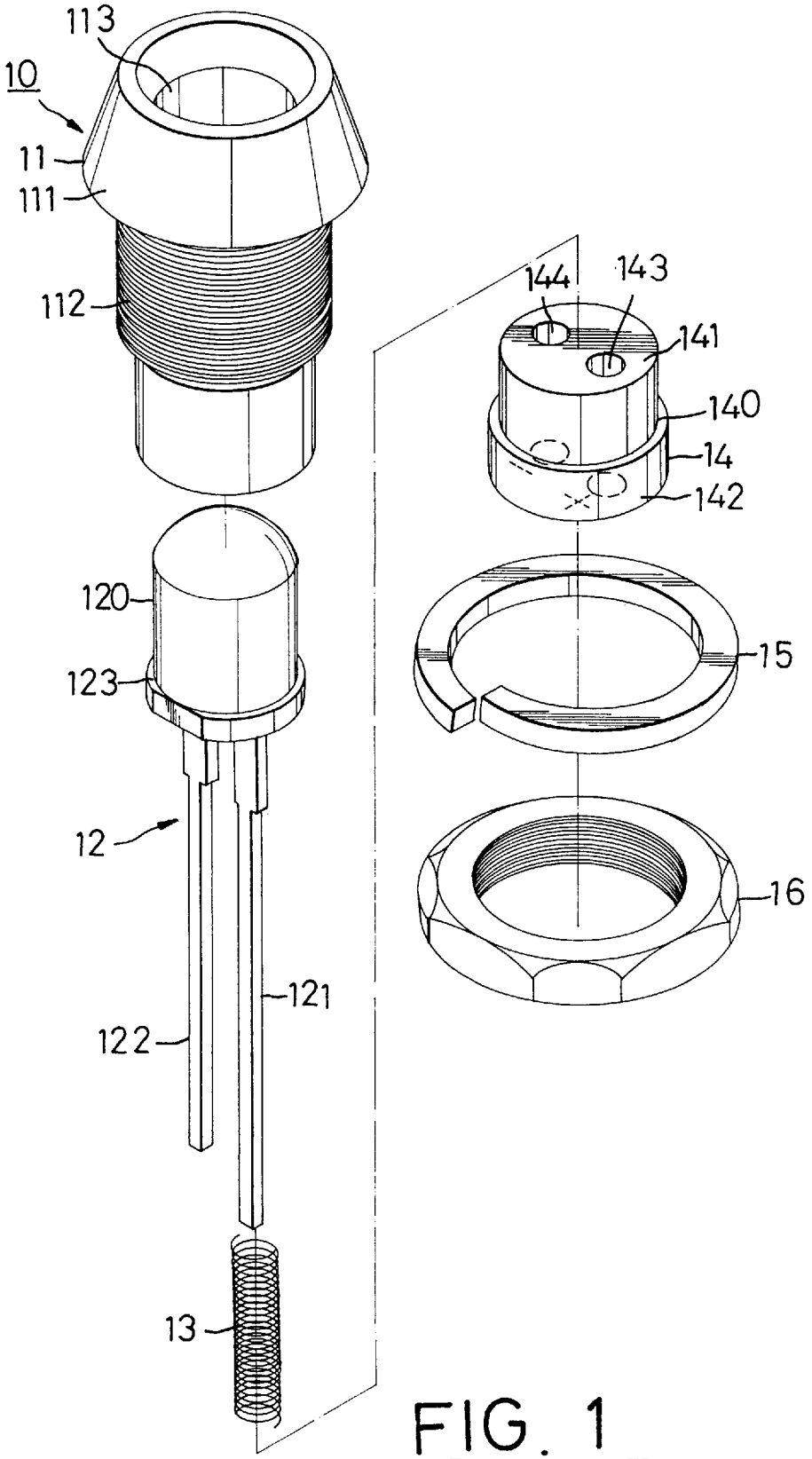
FIG. 1 PRIOR ART
FIG. 1 is an exploded view of a conventional indicating lamp.
Figures 2A, 2B:
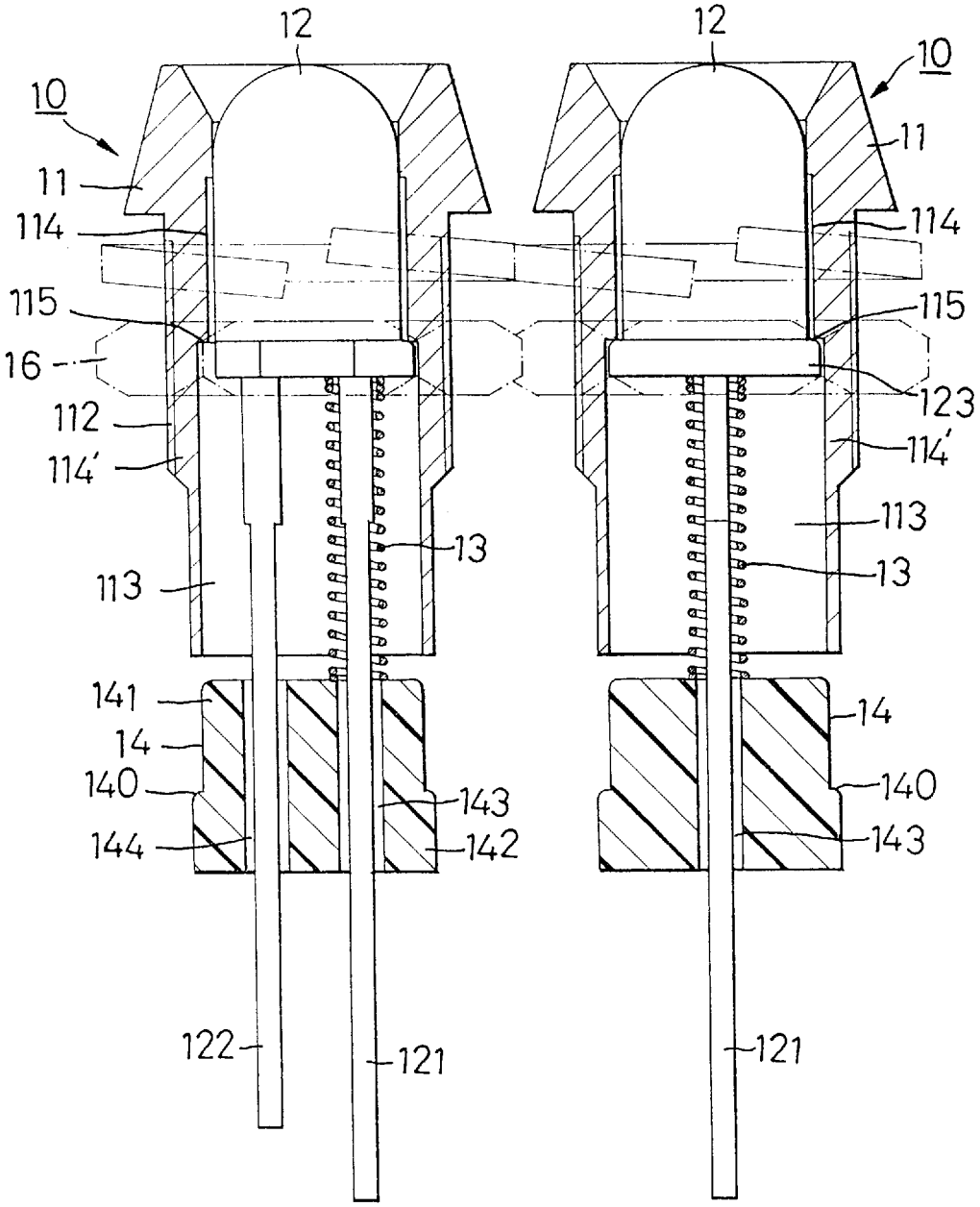
FIG. 2A PRIOR ART
FIG. 2B PRIOR ART
FIGS. 2A, 2B, 3A and 3B illustrates the assembly of the conventional indicating lamp.
Figure 3A:
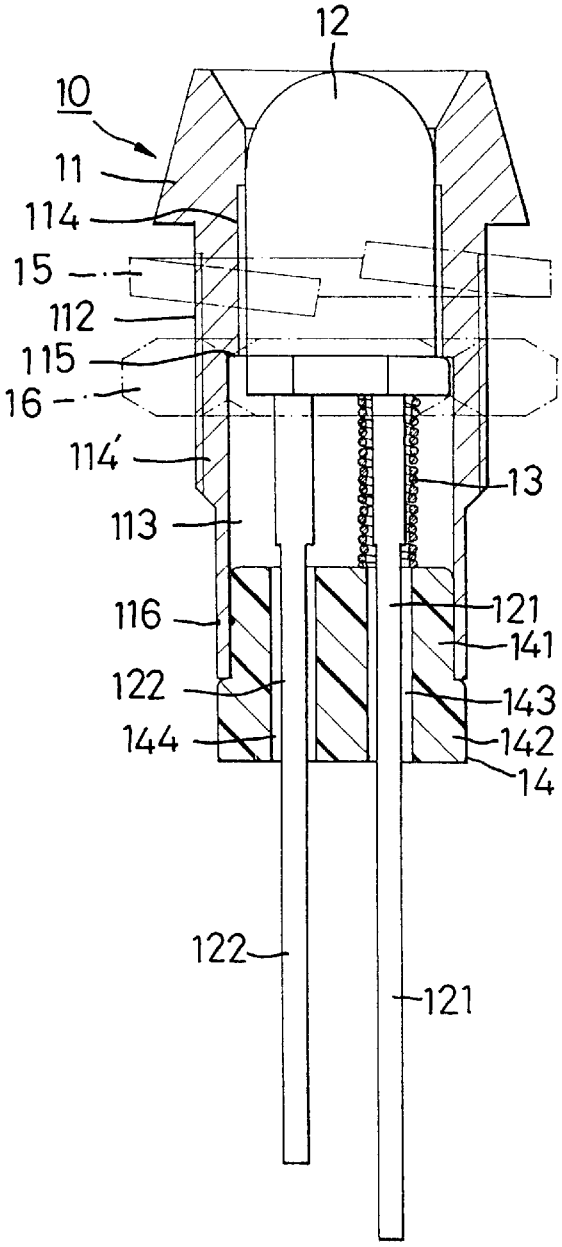
FIG. 3A PRIOR ART
Figure 3B:
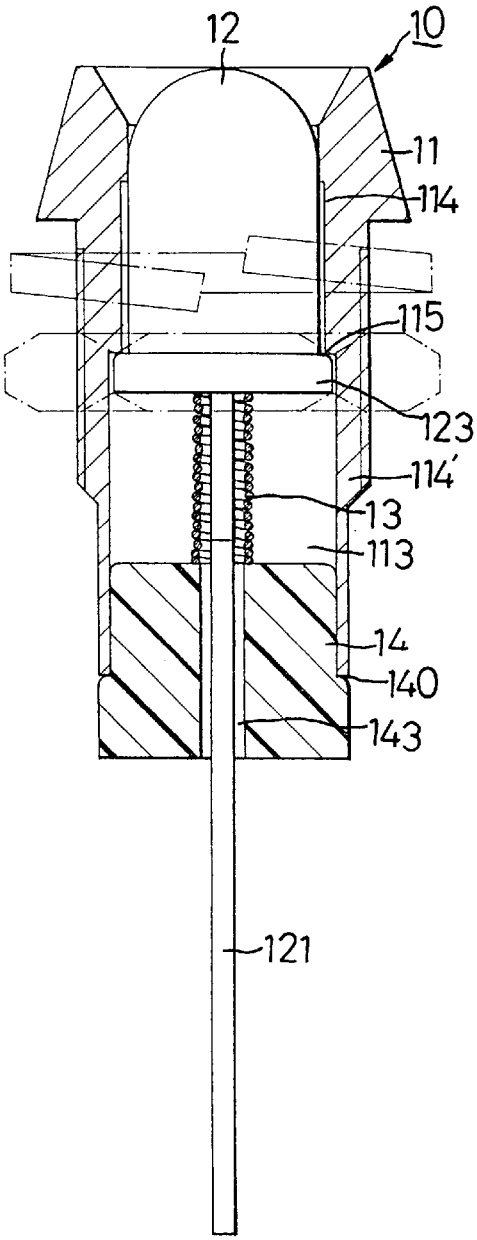
FIG. 3B PRIOR ART
Figure 4:
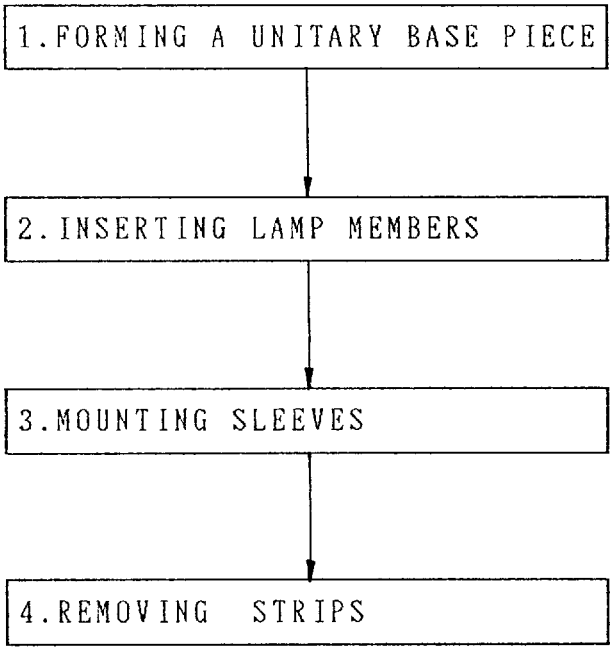
FIG. 4 is a flow chart illustrating a method for manufacturing a plurality of indicating lamps of this invention.
Figure 5:
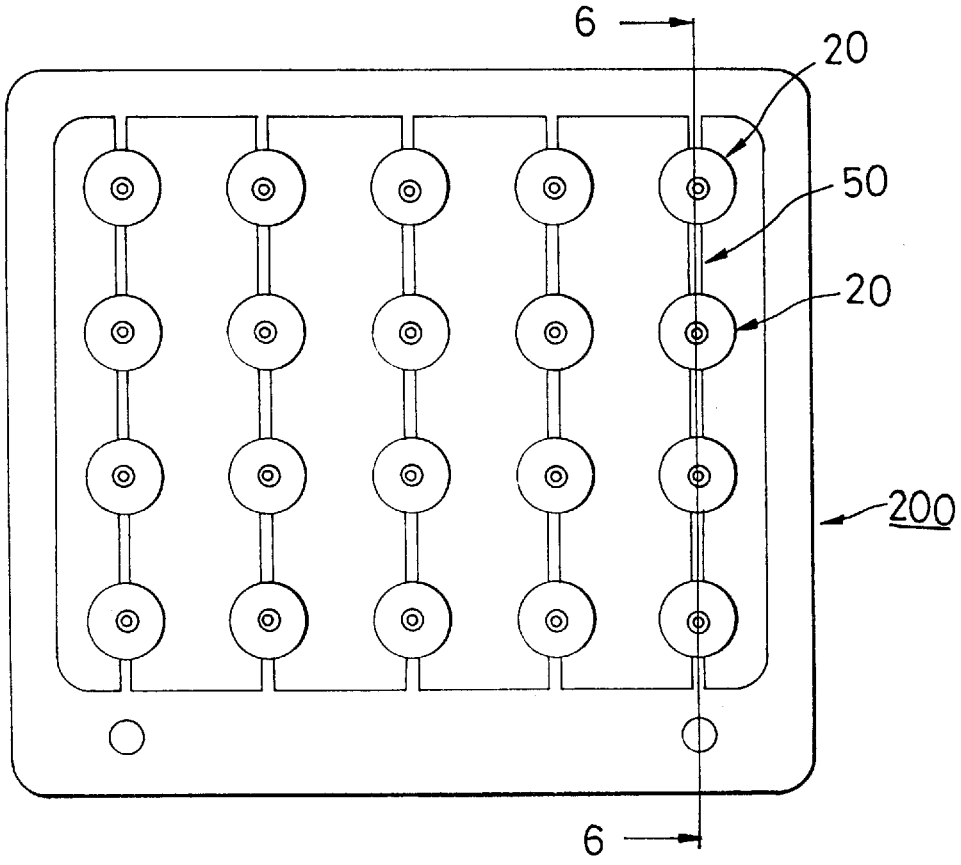
FIG. 5 illustrates a unitary rubber base piece used in the method for manufacturing the indicating lamps of this invention.
Figure 6:
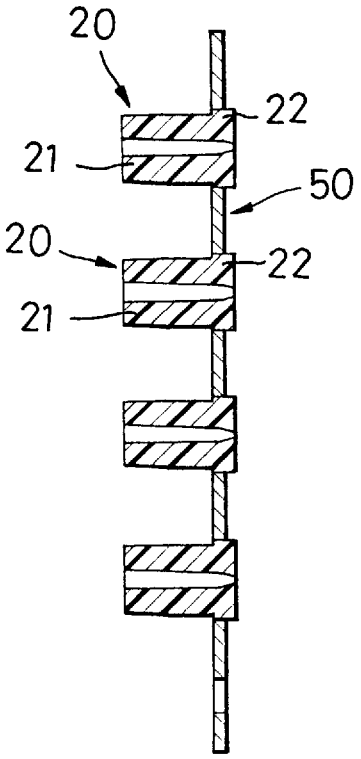
FIG. 6 is a sectional view taken along Line 6—6 in FIG. 5.
Figure 7:
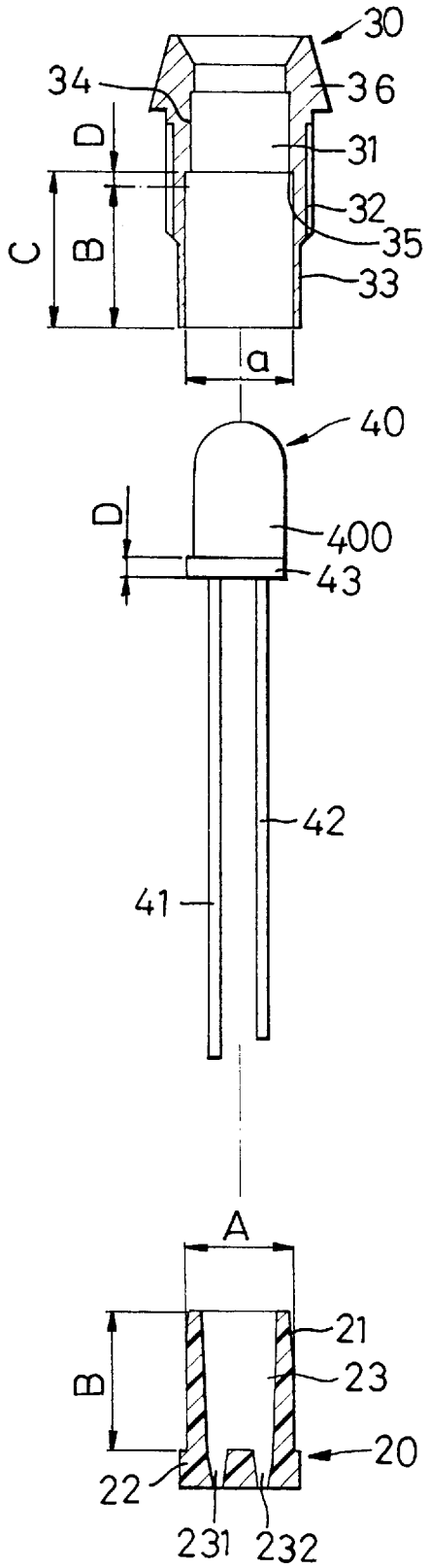
FIG. 7 is an exploded view of the preferred embodiment of an indicating lamp of this invention which is illustrated in FIG. 4.
Figure 8A:
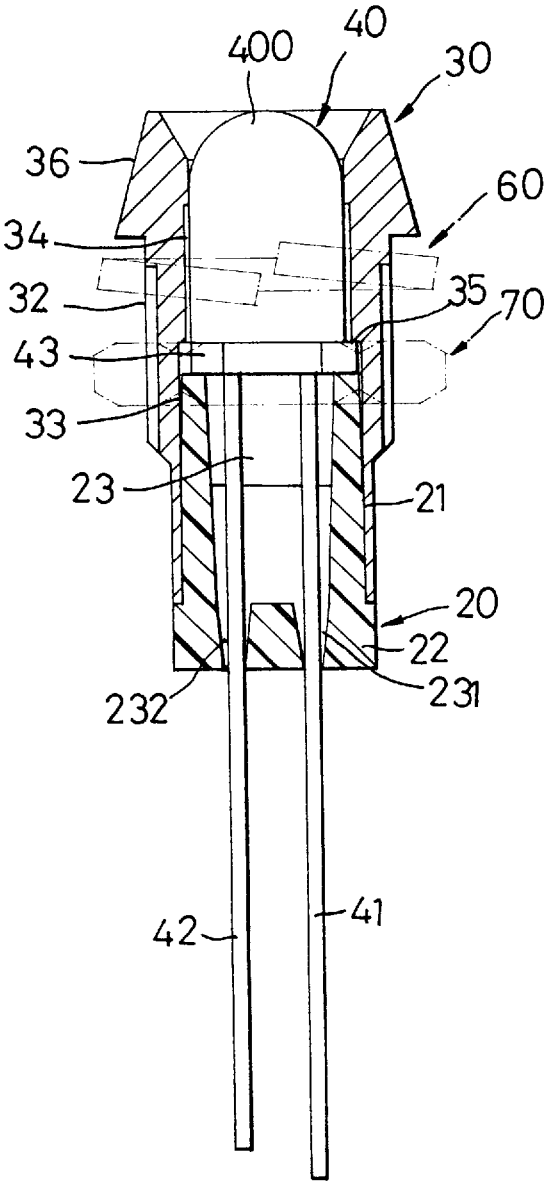
FIGS. 8A and 8B are sectional views of the preferred embodiment.
Figure 8B:
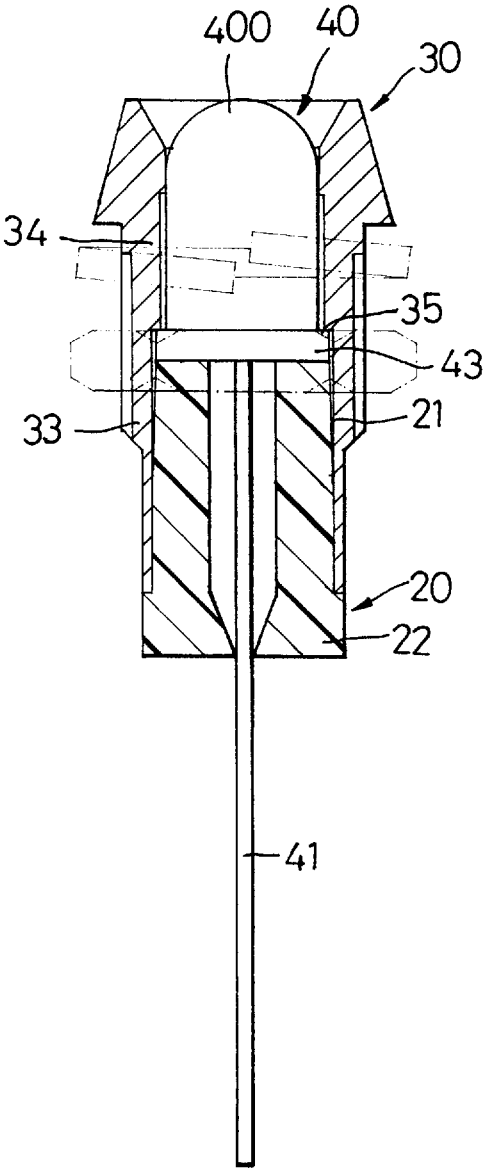

Referring to FIG. 4, a method for manufacturing a plurality of indicating lamps of this invention includes the steps of forming a unitary base piece, inserting lamp members, mounting sleeves, and removing strips. In particular, the method includes the following steps:

(1) forming a unitary base piece, as shown in FIGS. 5 and 6, the base piece 200 being made of a flexible, electrically insulating material which, in this embodiment, is rubber, and having a plurality of regularly arranged bases 20, each of which, as shown in FIGS. 7, 8A and 8B, has a pin hole unit that includes two regularly arranged pin holes 231, 232, the bases 20 being interconnected integrally by means of a plurality of connecting strips 50, each of the bases 20 having a thin upper insert end portion 21 and a thick lower end portion 22;

(2) respectively inserting pin units of a plurality of lamp members 40 into the pin holes 231, 232 of the bases 20, each of the lamp members 40 including the pin unit of a positive electrode pin 41 and a negative electrode pin 42 which are regularly arranged, after insertion into the pin holes 231, 232 of the corresponding base 20, relative to each other in a manner in which the pin holes 231, 232 of each of the bases 20 are arranged;

(3) respectively sleeving a plurality of sleeves 30 on the upper end portions 21 of the bases 20, the sleeves 30 having central bores 31 from the upper ends of which the lamp members 40 are visible after the sleeves 30 are sleeved on the bases 20; and (4) removing the connecting strips 50 from the bases 20.

The structure of a product made by the aforementioned method will be described in detail. As illustrated, the sleeve 30 has an externally threaded middle portion 32, a large-inner-diameter lower end portion 33, a small-inner-diameter upper portion 34, a shoulder 35 defined between the portions 33 and 34, and an outwardly extending flange 36.

The lamp member 40 has a generally cylindrical lamp body 400 received within the small-inner-diameter upper portion 34 of the sleeve 30, and an outwardly extending flange 43 which is formed on the lower end of the lamp body 400 and which is received within the large-inner-diameter lower end portion 33 of the sleeve 30. The flange 43 has an upper end abutting against the shoulder 35 of the sleeve 30, and a lower end abutting against the upper end of the base 20. As illustrated, the outer diameter of the flange 43 is larger than the inner diameter of the small-inner-diameter upper portion 34 of the sleeve 30, and smaller than the inner diameter of the large-inner-diameter lower end portion 33 of the sleeve 30 so that the lamp member 40 can be positioned within the sleeve 30 by contacting the flange 43 of the lamp member 40 with the shoulder 35 of the sleeve 30. The electrode pins 41, 42 are connected fixedly to the lower end of the lamp body 400.

The thin upper insert end portion 21 of the base 20 is tapered and reduces upwardly and gradually in outer diameter, thereby facilitating insertion of the base 20 into the sleeve 30.

The total of the length (B) of the thin upper insert end portion 21 of the base 20 and the length (D) of the flange 43 of the lamp member 40 is equal to the length (C) of the large-inner-diameter lower end portion 33 of the sleeve 30, so that, in assembly, the upper insert end portion 21 of the base 20 can impel the flange 43 of the lamp member 40 to contact the shoulder 35 of the sleeve 30 for positioning the lamp member 40 within the sleeve 30.

The outer diameter (A) of the upper insert end portion 21 of the base 20 is slightly larger than the inner diameter (a) of the large-inner-diameter lower end portion 33 of the sleeve 30, thereby enabling the upper insert end portion 21 of the base 20 to be press fitted within the sleeve 30.

A washer 60 and a nut 70 (indicated by the phantom lines) are disposed around the sleeve 30 in a known manner.

With this invention thus explained, it is apparent that numerous modifications and variations can be made without departing from the scope and spirit of this invention. It is therefore intended that this invention be limited only as indicated in the appended claims.

I claim:

1. An indicating lamp including:

a base having a pin hole unit that includes two aligned pin holes formed in said base;

a lamp member including a generally cylindrical lamp body that has a lower end formed with an outwardly extending flange, and an electrode pin unit that includes a positive electrode pin and a negative electrode pin which have upper ends connected fixedly to said lower end of said lamp body and which are respectively inserted into said pin holes of said base; and a sleeve having a central hole formed therethrough, a large-inner-diameter lower end portion and a small-inner-diameter upper portion a shoulder defined between inner surfaces of said end portions, said large-inner-diameter lower end portion having an inner diameter larger than that of said small-inner-diameter upper portion, said flange of said lamp member having an outer diameter which is smaller than the inner diameter of said large-inner-diameter lower end portion of said sleeve, said small-inner-diameter upper end portion of said sleeve having an inner diameter smaller than the outer diameter of said flange, said base having a lower end portion and an upper insert end portion which is press fitted within said lower end portion of said sleeve in such a manner that said lamp body is received within said small-inner-diameter upper portion of said sleeve and is visible from an upper end of said central hole of said sleeve, and that said flange of said lamp member is located within said large-inner-diameter lower end portion of said sleeve;

wherein said base is made of a flexible electrically insulating material, said large-inner-diameter lower end portion of said sleeve having a length which is equal to total length of said flange of said lamp body and said upper insert end portion of said base, total length of said flange of said lamp body and said base being larger than the length of said large-inner-diameter lower end portion of said sleeve, said upper insert end portion of said base having at least a portion which has an outer diameter slightly larger than the inner diameter of said large-inner-diameter lower end portion of said sleeve, said flange having an upper end abutting against said shoulder of said sleeve, and a lower end abutting against an upper end of said base.

2. An indicating lamp as claimed in claim 1, wherein said upper insert end from said lower end portion of said base portion of said base is tapered and is reduced upwardly and gradually insert in outer diameter in order to easily insert said upper insert end portion of said base into said sleeve during assembly.

* * * * *